US006247589B1

(12) United States Patent
Schonhardt et al.

(10) Patent No.: US 6,247,589 B1
(45) **Date of Patent: *Jun. 19, 2001**

(54) CONTAINER FOR AN ARTICLE OF HAND-HELD POWER EQUIPMENT

(75) Inventors: Patrick Harold Schonhardt, Braham; Charles E. Jacobucci, Mendota Heights, both of MN (US)

(73) Assignees: Stone Container Corporation, Chicago, IL (US); The Toro Company, Bloomington, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/379,177

(22) Filed: Aug. 23, 1999

Related U.S. Application Data

(62) Division of application No. 09/004,942, filed on Jan. 9, 1998, now Pat. No. 5,941,384.

(51) Int. Cl.[7] ..... B65D 85/00
(52) U.S. Cl. ..... 206/320; 206/349; 206/782
(58) Field of Search ..... 206/320, 319, 206/349, 576, 521, 775, 782, 783, 756, 763; 229/162

(56) References Cited

U.S. PATENT DOCUMENTS 2,321,473 * 6/1943 Ferguson ..... 206/783
2,854,135 * 9/1958 Pantalone ..... 206/783
3,489,269 * 1/1970 Rosenburg, Jr. ..... 206/783
5,823,339 * 10/1998 Dunham et al. ..... 206/782

* cited by examiner

*Primary Examiner*—Luan K. Bui
(74) *Attorney, Agent, or Firm*—Larkin, Hoffman, Daly & Lindgren, Ltd.

(57) ABSTRACT

A display carton and motorized implement arrangement is disclosed. The display arrangement includes an operator carriable motorized implement and a display carton having display and access apertures. Ideally, in its packaged state within the display carton, the motorized implement is substantially assembled so that the end user may easily and efficiently utilize the implement without extensive subsequent assembly or set-up. The display carton has a main body and upper and lower body portions. The display carton substantially entirely contains the implement and allows the display arrangement to be stably maintained on a flat surface. The main body includes a front, rear, and side panels. The front panel includes a pair of display apertures to allow access to the retained implement at the point of sale. The front panel further includes a central panel portion, spaced between the pair of display apertures. Display apertures may be formed, at least in part, by inwardly biasing a retaining panel portion of the front panel toward the rear panel. The retaining panel may include a retaining structure for engaging and stabilizing the contained implement.

4 Claims, 4 Drawing Sheets

CONTAINER FOR AN ARTICLE OF HAND-HELD POWER EQUIPMENT

BACKGROUND OF THE INVENTION

This application is a division of U.S. application Ser. No. 09/004,942, filed Jan. 9, 1998, and now U.S. Pat. No. 5,941,384.

1. Field of the Invention

This invention relates to cartons and other similar box packages, and more specifically to a carton which substantially encloses an article of hand-held outdoor power equipment yet permits the purchaser to physically access portions of the article.

2. Description of the Prior Art

Point-of-sale packaging is, of course, a well known concept for shipment and display of products prior to sale. Usually this packaging is a box or carton which includes artistic designs to be both attractive and attention-getting. In order to protect the product and other contents from damage, loss, or theft, a completely closed carton is often desirable. A completely closed carton generally provides a convenient and secure manner for both shipping and displaying a product that may include additional parts, such as assembly fasteners, manuals, warranty, and the like. A variety of advertising and both graphical and textual product descriptions are typically found on the exterior panels of the box. Very often, the box graphics pictorially depict the enclosed product so that the consumer can see, among other items, the product manufacturer and trade dress, the product type, color, style, and size, and the product's intended use. Furthermore, closed cartons are generally manufactured relatively simply and efficiently with automatic machinery, and often an entire carton can be formed from a single blank of corrugated material or paperboard. However, traditional point-of-sale packaging which completely encloses the product from the consumer's view or touch is not satisfactory for displaying some products, especially products that a consumer may desire to visually and tactilely access to evaluate and determine whether or not to purchase the product.

Point-of-sale packages for powered hand-held yard implements are also known. These yard implements may include, for example, grass trimmers and snow-throwing devices, such as the line of flexible filament grass trimmers and the Power Shovel® snowthrower, respectively, manufactured by The Toro Company of Bloomington, Minn. Typical point-of-sale packages for powered, hand-held yard implements have generally included a corrugated paper box that completely encloses the implement at the point of sale. Typical graphics and written matter on panels of these implement boxes often attempt to convey to the consumer some of the implement's desirable features such as durability, feel and comfort of use, function, and ease of use, but these factors are difficult to convey to a customer visually rather than by actual physical contact or simulated use.

As with other consumer products, powered yard implements are specifically designed to be rugged and withstand abuse. The durability of a yard implement is often a major consideration for a consumer in deciding whether to purchase the item. Accordingly, consumers desire the opportunity to visually and tactilely access the implement prior to purchase to qualitatively assess durability and other factors such as the comfort, feel, weight, and balance of the item. Some retailers of these powered implements accommodate the consumer's desire to physically assess and handle the implement by providing a display model on the retail floor. However, retailers providing such display models may incur considerable expense in maintaining a large display inventory of several brands and models, for damaged or lost display products, for lost profits as the display products cannot be sold at normal prices, and for loss of shelf inventory to accommodate the display implements. Unfortunately, for some retailers who do not provide display models, a consumer desiring to independently assess the implement may resort to opening and removing the implement from the box, resulting in an opened or damaged package which may be difficult to sell later, or damage to a product that is not detected until a later purchaser returns it. Customers may also be leery of purchasing implements within open boxes, and this can result in unsaleable merchandise. Yet for many consumers the first opportunity to assess the implement for comfort, quality, balance, and other features is after purchase which also may result in additional store returns, restocking, and expensive customer service transaction costs. The foregoing problems are reduced by allowing the consumer to both see and touch the implement at the point of sale.

Many powered implements are elongate in design, and include a handle and a heavier working or functional end. Some packaging for these powered implements is sized to receive a disassembled implement, the height of these boxes being substantially shorter than the height of the subsequently assembled implement. Reference may be made to U.S. Pat. No. 4,829,675 to Beihoffer, as an example of an implement which may be shipped in a "knocked down" or partially-disassembled state.

On the other hand, some consumers may prefer to purchase substantially or fully assembled implements which can be quickly placed in use. Manufacturers of powered implements have addressed this consumer desire by shipping and displaying substantially fully assembled implements within large enclosed boxes, the consumer having only to add minor componentry or perform slight adjustments prior to the intended use. Typical boxes for a substantially or fully assembled implements include a base upon which the carton is rested, wherein the elongate implement is maintained in a stable, upright or vertical orientation. Importantly, by fully-enclosing the implement within a carton, the implement is protected from damage, loss, or theft of parts during shipping and subsequent display.

Shipping and display cartons for substantially assembled powered yard implements are know which allow the consumer to partially access the implement without removal from the carton. Such cartons are disclosed in U.S. Pat. Nos. 5,332,085 and 5,495,937 to Fraser. Cartons according to the Fraser '085 and '937 patents are generally "C-shaped," having a body with a large open central channel extending nearly the entire length of the carton which reveals the contained implement. As a result of the relatively large exposure of the implement through the open central region, these cartons may be characterized as "partially enclosing" the implement. A detrimental result of only partially enclosing an implement is exposure of the implement to damage during shipping and display. For example, nearly the entire handle member of a powered implement is exposed and unprotected when packaged according to the Fraser '085 and '937 patents.

In addition, the art in this area teaches packaging for grass-trimmers in which a trimmer guard and handle extension member are attached in-place on the trimmer. This unduly extends the "depth" and the "width" of the overall trimmer package.

Furthermore, cartons of the type disclosed in the Fraser '085 and '937 patents, unlike simple one-piece blank-formed cartons, are comprised of multiple parts including a separate body, top retainer structure, and bottom retainer structure. Multiple-part cartons are often less economical to manufacture because additional material and fabrication steps are needed to form the retainer structures. Multiple-part cartons are often less efficient to erect prior to receiving a product because the retainer structures have to be manually formed and positioned relative to the product and the carton body.

Finally, cartons of the type disclosed in the Fraser '085 and '937 patents are also perceived to be less rigid and protective as compared to a fully or (substantially-fully) enclosed carton. Such cartons are also harder to stack because they are not rectangular with flat side panels and are therefore less suitable for shipping and stacking products A need therefore has arisen for a carton to hold a substantially or fully assembled powered implement which to a large extent provides protection against damage by "substantially enclosing" the implement, but further includes suitably located openings or access ways in the carton which allow the consumer to examine and handle the implement prior to purchase.

SUMMARY OF THE INVENTION

Addressing these and other concerns, the present invention is directed to a container apparatus for substantially enclosing a powered hand-held yard implement. The container of the present invention substantially encloses the implement to protect against damage, yet also provides apertures through which the consumer can examine and touch specific features of the implement. The container has a body portion defining an interior cavity for receiving the implement. The body portion includes a front panel, a rear panel, and a pair of side panels, each of which may include one or more display apertures which allow the consumer to visually and tactilely access the product at the point of sale. Preferably along the front panel, the consumer is provided access to both a handle portion and a functional portion of the implement. At least one of the display apertures of the front panel is formed by manipulating a hinged retaining panel toward the rear panel and into engagement with the implement to form a support for stabilizing the implement within the container. The front panel further includes a center panel for improving the rigidity of the container, the center panel spanning between the side panels and spaced between the display apertures.

In accordance with another aspect of the invention, the carton substantially encloses the implement and thus provides a damage-resistant container for shipping and displaying the implement, yet at the same time providing display apertures to allow access to the implement.

A related consideration is the machinery which makes the container. It is desirable to provide a blank which can be stamped, folded, and glued by automatic machinery. It is highly desirable that the package be formed from a single blank of material, thereby minimizing assembly and erection costs. Further, a desirable feature of the present invention is that the container, formed from a single blank of corrugated paper material, does not require the addition of separate retainer members or support structures to stably maintain or hold the implement within the carton.

A feature of the present invention is providing an implement container which permits the consumer to access the handle portion of the implement so it may be used when carrying the contained implement in the package.

Another feature of the present invention is providing "secure" regions within the implement container for storing small items associated with the implement.

Still another feature of the present invention is providing a sturdy package which allows the implement to be maintained in an upright vertical orientation, and to be stacked uniformly and stably with other like packages In one embodiment, the carton is formed to have a generally elongate rectangularly-shaped front panel, rear panel, and side panels. This allows for extensive imprinting of promotional and informational material to be effectively exhibited to the consumer.

Accordingly, the container of the present invention provides several practical advantages, such as allowing display of and access to a hand-held powered yard implement at the point of sale, while simultaneously providing a sturdy "substantially-closed" rectangular container for protection of the implement during handling and shipping.

In one embodiment of the invention, three display apertures are positioned on the container, the front panel having an upper and lower display aperture and a side panel having a central display aperture. In another embodiment, one of the front display apertures is formed by manipulating a hinged retaining panel toward the rear panel and into engagement with the implement to serve as a support.

DETAILED DESCRIPTION OF THE INVENTION

Figure 1:
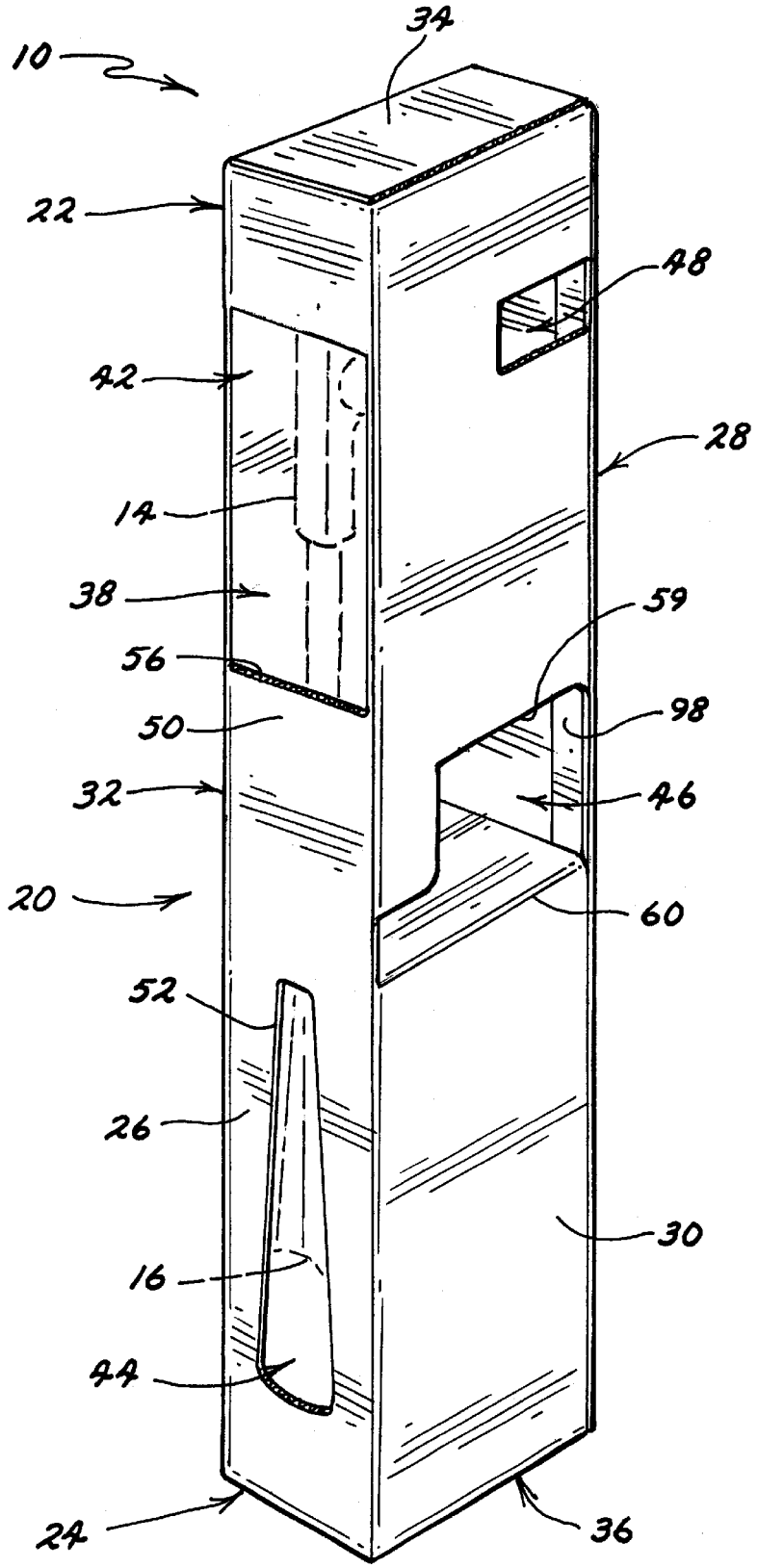
FIG. 1 is a front perspective view of an embodiment of a container apparatus according to the present invention showing a powered hand-held yard implement in phantom within the container.

While this invention is readily susceptible to embodiment in many different forms, there is shown in the drawings and will be described herein in detail a specific embodiment, with the understanding that this embodiment is to be considered as exemplary of the principles of the invention, and is not intended to limit the invention to the illustrated embodiment.

Referring to FIG. 1, a carton 10 for a substantially assembled powered hand-held yard implement 12 in accordance with the present invention is shown. Overall, the carton 10 is generally rectangularly shaped and includes front, back, and side panels 26, 28, 30, 32 which together define an interior cavity 38 for receiving the implement 12. The carton 10 further includes access apertures or openings 42, 44, 46, 48 which allow the consumer to view and physically assess the implement 12 at the point of sale. The implement 12, illustrated in the drawings in phantom, is an electrically-powered filament-type grass trimmer 12 having a functional or working end 16 and a handle 14. Assembly of the carton 10 will be discussed below, as will the placement and packaging of the implement 12 within the carton 10. As shown in FIG. 1, the carton 10 may be placed in a preferred vertical orientation with the handle 14 of the trimmer 12 positioned above the functional end 16. The present invention is not limited to packaging for grass trimmers 12, as cartons 10 for other powered hand-held yard implements may also be made in accordance with the present invention.

Figure 5:
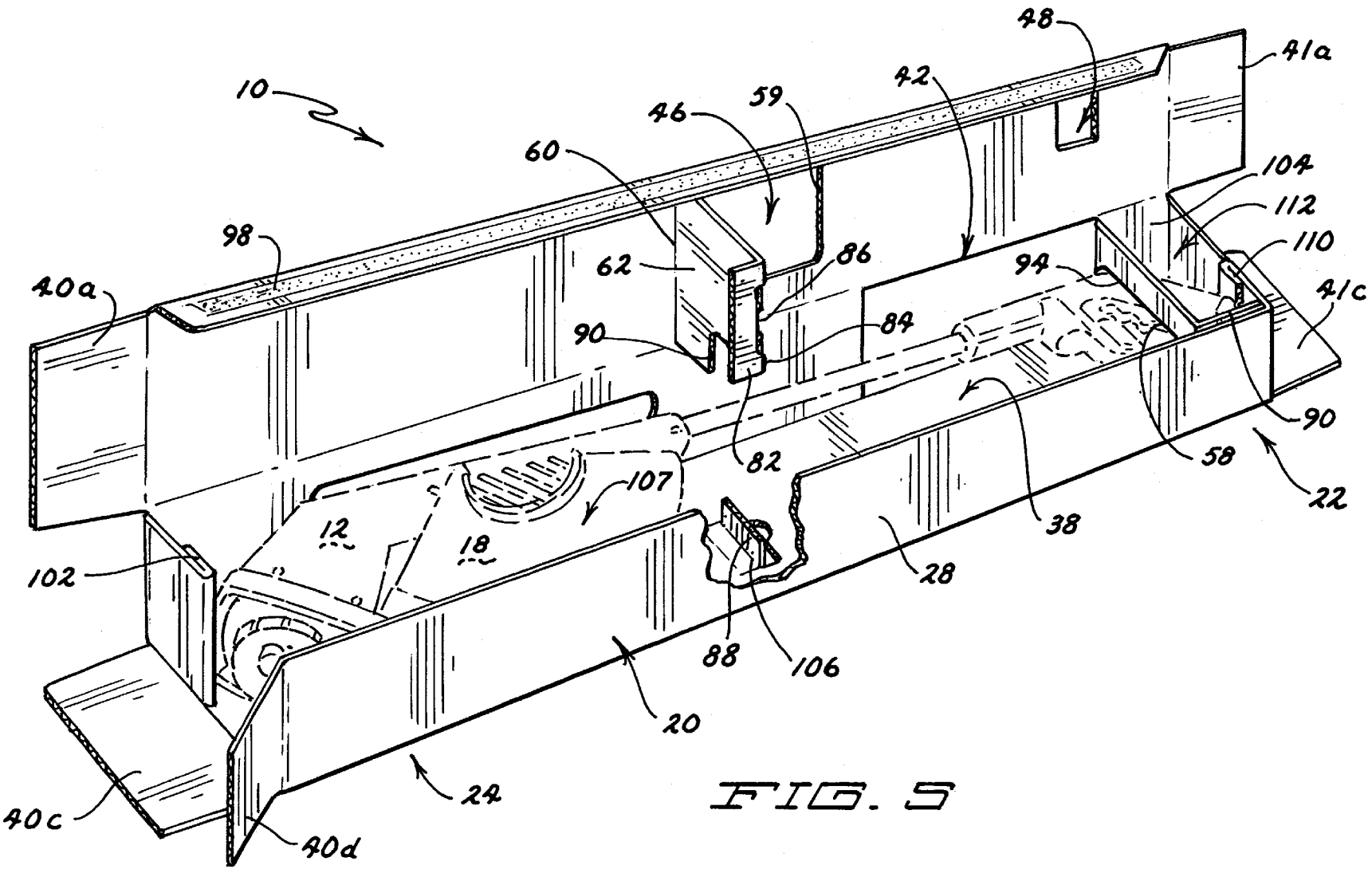
FIG. 5 is a perspective view of a partially-assembled container of FIG. 1.

The carton 10 of the present invention has a body portion 20, a top portion 22, and a bottom portion 24. Top portion 22 and bottom portion 24 are opposed and spaced apart by the body portion 20. Referring to FIG. 1, body portion 20 of the carton 10 includes a front panel 26, a rear panel 28, and a right side panel 30 and a left side panel 32 which extend between the front panel 26 and the rear panel 28. Body portion 20 is substantially rectangular when viewed in a horizontal or transverse cross section. A generally right angle relationship exists between the front panel 26 and each side panel 30, 32 and between the rear panel 28 and each side panel 30, 32. Front panel 26 and rear panel 28 are thus in substantial parallel alignment with each other. Carton 10 further includes a top panel 34 and a base panel 36. Taken together, the front panel 26, the rear panel 28, and the side panels 30, 32 together define an interior cavity 38 for receiving the trimmer 12. As is best shown in FIGS. 1 and 5, the interior cavity 38 is sized to relatively closely accommodate the trimmer 12 along its length, width, and height dimensions. The interior cavity 38 is closed at the bottom portion 24 of the carton 10 by the base panel 36. Base panel 36 is formed from overlapping base panel sections 40*a–d*. Base panel 36 preferably maintains the carton 10 and implement 12 in an upright or vertical orientation when the carton 10 is placed on a flat horizontal surface such as a floor or shelf. Likewise, the interior cavity 38 is closed at the top portion 22 by the top panel 34. Top panel 34 is formed from overlapping top panel sections 41*a–d*.

Referring to FIG. 1, the carton 10 of the present invention further includes implement display apertures 42, 44, 46, 48. Display apertures 42, 44, 46, 48 are preferably sized to permit access through an associated panel so as to allow the consumer to examine the implement 12. An embodiment of the invention shown in the drawings includes an upper display aperture 42 and a lower display aperture 44 both formed as part of the front panel 26, and a central display aperture 46 formed as part of the right side panel 30. Each display aperture 42, 44, 46, 48 is sized to permit a consumer to visually and tactilely access a portion of the trimmer 12. With reference to upper display aperture 42 of the front panel 26, a consumer may extend their hand therethrough to grasp the handle end 14 of the trimmer 12. With reference to the lower display aperture 44 of the front panel 26, a consumer may likewise assess features of the functional end 16 of the trimmer 12. The central display aperture 46 of the right side panel 30 provides the consumer yet another vantage to assess the features of the trimmer 12. The display apertures 42, 44, 46, 48 of the illustrated embodiment also provide the consumer convenient access to the trimmer 12 to assist in transporting the carton 10 and implement 12.

Figure 2:
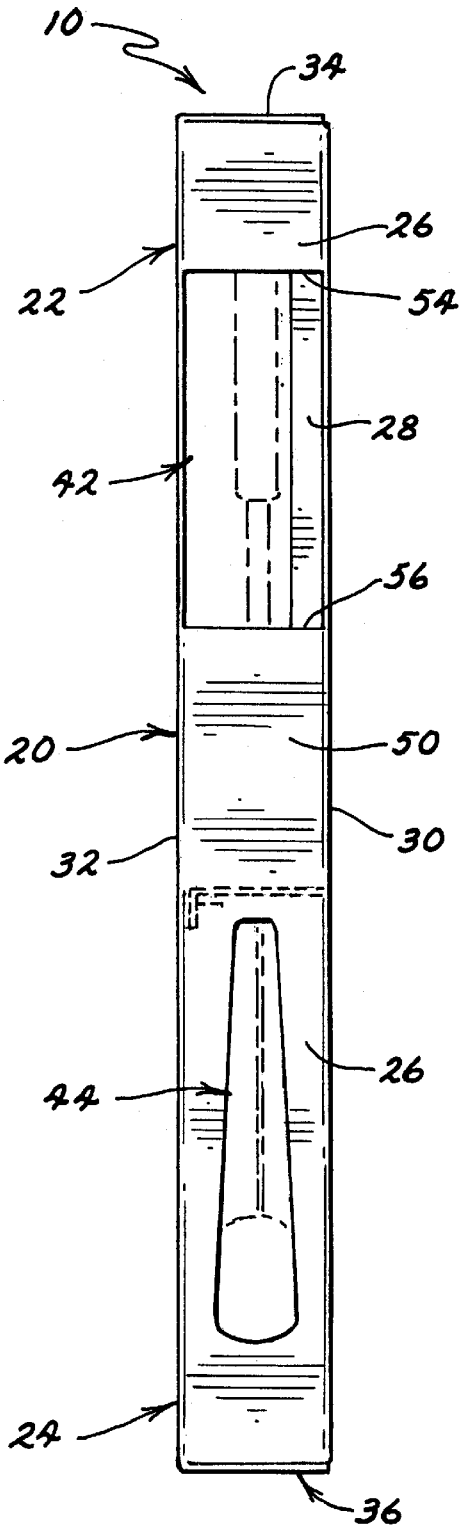
FIG. 2 is a front elevational view of the container of FIG. 1 showing the container in a vertical orientation.
Figure 4:
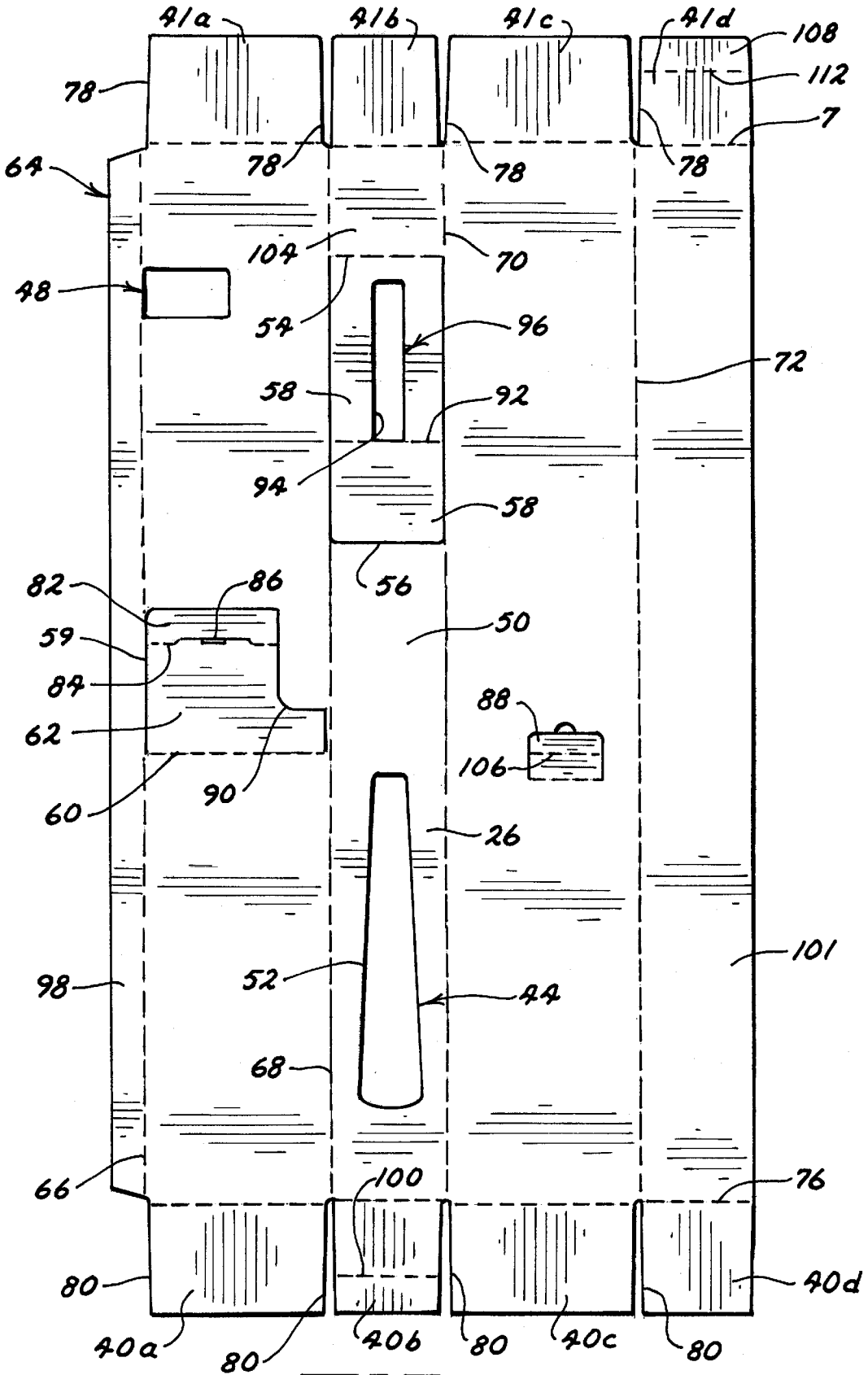
FIG. 4 is a plan view of the blank utilized to form the container shown in FIG. 1.

Referring now to FIGS. 1, 2, and 4, the front panel 26 includes a lower display aperture 44 and an upper display aperture 42. Lower display aperture 44 and upper display aperture 42 are spaced apart by a central panel section 50 which spans between the side panels 30, 32. The lower display aperture 44 is formed by removing a portion of the front panel 26 generally adjacent the lower functional end 16 of the trimmer 12 along cut line 52. This display aperture 44 may be formed by well known die-cutting techniques to remove a portion of the front panel 26. In the illustrated embodiment, the shape of lower display aperture 44 is generally contoured relative to the shape of a portion of the functional end 16 of the trimmer 12, though alternative forms may also be practicable depending primarily on the particular implement 12. The upper display aperture 42 extends laterally between the side panels 30, 32 and longitudinally between fold line 54 and cut line 56. The upper display aperture 42 is formed by manipulating an upper hinged retaining panel 58 toward the rear panel 28 in a manner described below, the retaining panel being defined by and extending from the front panel 26.

Figure 3:
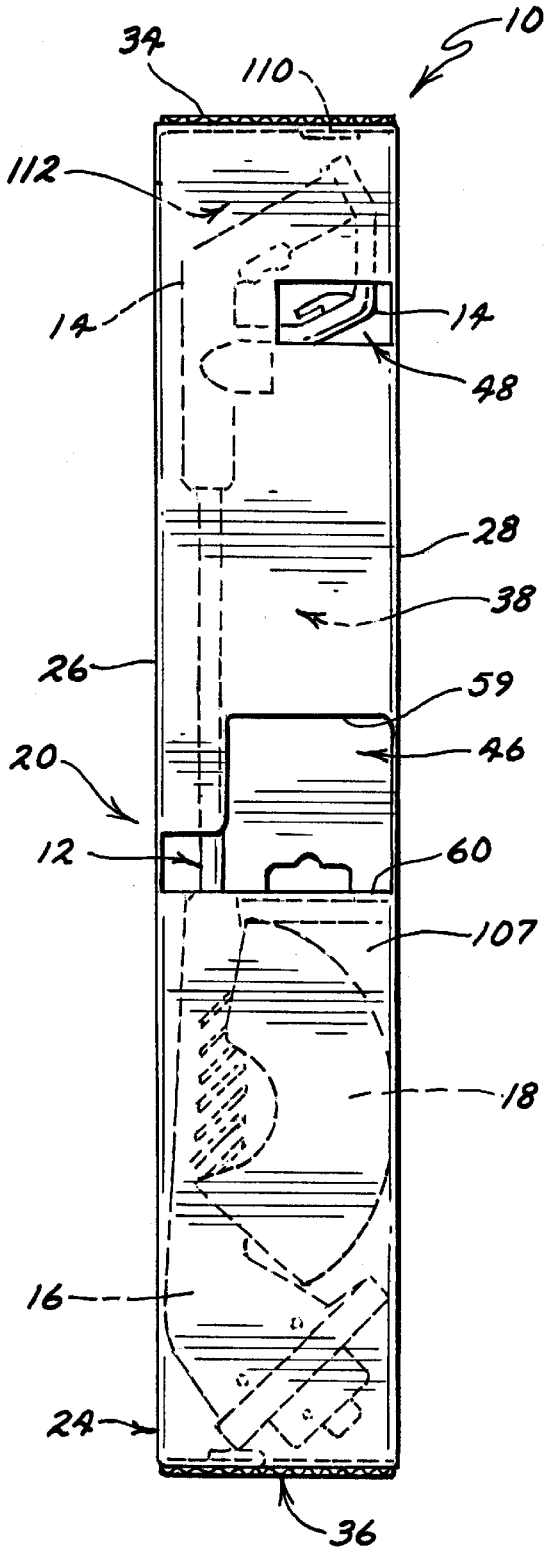
FIG. 3 is a side elevational view of the container of FIG. 1.

Referring now to FIGS. 1, 3, and 5, right side panel 30 includes a central display aperture 46 that is generally "L" shaped and extends laterally between the front panel 26 and the rear panel 28, and longitudinally between cut line 59 and fold or hinge line 60. Similar to the upper display aperture 42 of the front panel 26, the central display aperture 46 is formed by articulating a retaining panel 62 toward the opposite left side panel 32 in a later described manner. Right side panel 30 may further include an upper display aperture 48 allowing the consumer to view an upper portion of the handle member 14 of the implement 12.

Illustrated in FIG. 4 is a material blank 64 which is used to form the container 10 in FIG. 1. Blank 64 is preferably formed from a single sheet of corrugated paper material, although alternatively either a multiple-piece blank 64 or another suitable material could be selected as dictated by the particular application. The view of FIG. 4 is of the interior surfaces of the container 10. Major panel sections are defined along longitudinal fold lines 66, 68, 70, 72 and an upper transversely-extending fold line 74 and a lower transversely extending fold line 76. The top panel sections 41*a–d* are defined by spaced cut lines 78 and the upper transversely extending fold line 74. Similarly, the base panel sections 40*a–d* are defined by the lower transversely extending fold line 76 and spaced cut lines 80. Fold lines 66, 68, 70, 72 and cut lines 78, 80 may be formed in any conventional manner. Still referring to FIG. 4, the material blank 64 includes a right-side retaining panel 62 and the front retaining panel 58. The right side retaining panel 62 is defined along cut line 59 and the hinge line 60, as illustrated in FIG. 5. Right side retaining panel 62 further includes an flap portion 82, defined by cut line 59 and fold line 84, which contacts the left side panel 32 after the retaining panel 62 is articulated into place along hinge line 60. A slot 86 is formed along a portion of the fold line 84 and is sized to receive an extending portion of a locking ear 88 during assembly as will be described below. Central retaining panel 62 further includes a retaining surface 90 for contact with the implement 12 to assist in stabilizing the implement 12 within the carton 10.

Front retaining panel 58 is defined by cut line 56 and hinge line 54. A portion of cut line 56 is coextensive with longitudinal fold lines 68, 70 of carton 10 resulting in the width of upper retaining panel 58 being equal to the distance between left side panel 32 and right side panel 30. Upper retaining panel 58 further includes a projecting portion 59, defined by cut line 56 and fold line 92. Once the implement 12 is received into the carton 10 in a below described manner, projecting portion 90 abuttingly contacts a portion of the rear panel 28 of the carton 10 as shown in FIG. 5. Upper retaining panel 58 further includes a retaining surface 94 for assisting in stabilizing and securing the implement 12 within the carton 10. Retaining surface 94 extends around the periphery of slot 96 which is sized to receive a portion of the handle 14 of the trimmer 12 as shown in FIG. 5.

The blank 64 further includes a glue panel 98 used during assembly of the container 10 to secure the right side panel 30 to the rear panel 28. During assembly of the container 10, the glue panel 98 is preferably adhered to an edge 101 of the rear panel 28 along its length as partially shown in FIG. 1. The container 10 can then be compressed and flattened along the longitudinal fold lines 66, 68, 70, 72. The result is a flattened container 10 which is particularly suited for bulk shipment from the point of manufacture of the container 10 to the point where the trimmer 12 is inserted into the container 10.

The insertion of the trimmer 12 within the container 10 can be described with reference to FIGS. 1 and 5. The container 10 may be erected from a flattened state (discussed above) to a form ready for reception of the trimmer 12 by applying pressure to diametrically opposed corner edges of the flattened container 10 to square the container 10 into the preferred rectangular shape. Once the container 10 is squared, the base panel 36 can be formed by folding the base panel sections 40*a–d* along fold lines 76 in an overlapping manner. The base panel section 40*b* associated with the front panel 26 of the container 10 preferably includes a second fold line 100 allowing an outwardly extended portion of this base panel section 40*b* to be folded over to form an increased-thickness portion 102 of the base panel 36 for supporting and cushioning the trimmer 12 as shown in FIG. 5. Base panel sections 40*a–d* are folded in overlapping fashion to form the base panel 36 and are secured with tape, glue, staples, or any other known fastening or securing technique.

The upper retaining panel 58 is then folded across the fold line 54 and held so that the upper retaining panel 58 is temporarily at or near abutting contact with the interior surface 104 of the front panel 26. The trimmer 12 is next longitudinally inserted into the interior cavity 38 from the top portion 22 of the container 10 with the functional end 16 of the trimmer 12 stopping in contact with the base panel 36. Preferably, a portion of the functional end 16 of the trimmer 12 contacts the increased-thickness portion 102 of the base panel 36 as shown in FIG. 5. A trimmer guard 18 or other additional parts may then be loaded into the interior cavity 38 and positioned proximate to the functional end 16 of the trimmer 12.

The central retaining panel 62 may then be folded to form a retaining structure 90 and central display aperture 46. First, the tab portion 82 of the central retaining panel 62 is prepared by folding it generally perpendicular to the central retaining panel 62 along fold line 84. Next, the central retaining panel 62 is folded generally perpendicular across fold line 60 and inward toward the left side panel 32. As a result, the tab portion 82 abuttingly contacts a portion of the left side panel 32 and the retaining surface 90 contacts a portion of the handle 14 of the trimmer 12. The locking ear 88 of left side panel 32 is finally bent about fold line 106 and inserted through the slot 86 in central retaining panel 62 to assist in maintaining the central retaining panel 62 in a generally perpendicular relationship relative to the side panels 30, 32. Right side retaining panel 62 cooperatively engages the front panel 26 and rear panel 28 to enhance the overall structural rigidity of the container 10. As a result, a relatively secure interior region 107 is created within the interior cavity 38 between the base panel 36 and the horizontally positioned central retaining panel 62 and behind the trimmer 12. The guard 18 and any additional parts are securely maintained therein during shipping and display.

A further step in the packaging of the trimmer 12 within the container 10 is releasing the upper retaining panel 58 from its temporary abutting contact with the interior surface 104 of the front panel 26 and positioning the upper retaining panel 58 into generally perpendicular orientation with respect to the front panel 26. The tab portion 59 is folded across fold line 92 and into contact with a portion of the rear panel 28 as shown in FIG. 5. Furthermore, as upper retaining panel 58 is lowered into position, the retaining surfaces 94 engages a portion of the handle end 14 of the trimmer 12.

As a final step, the top panel 34 is formed by folding top panel sections 41*a–d* generally perpendicular to their respective front panel 26, rear panel 28, or side panel 30, 32 and into an overlapping relationship. The top panel section 41*d* associated with the rear panel 28 preferably includes an articulating panel 108 which, when folded across fold line 114, provides another shock-resisting region 110 for contact with the uppermost portion of the trimmer 12. Top panel sections 41*a–d* are likewise secured in conventional manner to form the top panel 34. Another secure area 112 is formed within the interior cavity 38 between the upper retaining panel 58 and the top panel 34.

The retaining panels 58, 62 each form at least a portion of an associated display aperture 46, 42, and function to positively retain the implement 12 within the container 10. The container 10 of this invention thus provides for positive retention of the trimmer 12 within the container 10.

The container of the present invention substantially encloses a powered implement 12 and provides display apertures 42, 44, 46, 48 which allow a consumer to access the product both visually and tactilely. In one embodiment, the front panel 26 of the container 10 includes the pair of display apertures 42, 44 which are separated by a central panel section 50 which spans between the side panels 30, 32. This central panel 50 functions to increase the overall rigidity of the container 10, and otherwise strengthens the container 10 to minimize or prevent damage to the contents during shipping and subsequent display in a vertical orientation as shown in FIG. 1.

While the preferred embodiments of the above implement container have been described in detail with reference to the attached drawings, it is understood that various changes, modifications, and adaptations may be made in the container without departing from the spirit and scope of the appended claims.

What is claimed is:

1. A point of sale display apparatus for a hand-held outdoor power equipment implement, the implement being of the type which includes an upper hand grip which a user grips to at least partially hold the implement, a lower tool for performing a ground maintenance operation, and an intermediate connecting section for connecting the upper hand grip and the lower tool, which comprises:

an elongated rectangular carton defined by a front panel, a rear panel, two side panels, a top panel and a bottom panel, the implement being stored vertically in the carton with the lower tool being adjacent the bottom panel of the carton and the upper hand grip being adjacent the top panel of the carton, and one of the front and two side panels having an implement retaining panel articulable about a hinge line;

at least one display opening provided in an upper portion of the carton which is large enough to allow a user's hand to reach into the carton and grab and manipulate the implement while the implement is within the carton;

an enclosed storage compartment provided in a lower portion of the carton beneath the at least one display opening, the storage compartment being formed by the bottom panel, by lower portions of the front panel, rear panel and side panels, and by the implement retaining panel to enclose at least the lower tool of the implement; and a display aperture opening into the storage compartment, the display aperture being sized and located to allow a portion of the implement housed within the storage compartment to be seen and touched but with the display aperture so closely overlying the portion of the implement housed within the storage compartment to prevent the user from placing his hand into the storage compartment and to retain the stored item within the storage compartment.

2. A point of sale display apparatus according to claim 1, wherein both the display opening and the display aperture are provided in the front panel of the carton.

3. A point of sale display apparatus for a hand-held outdoor power equipment implement, the implement being of the type which includes an upper hand grip which a user grips to at least partially hold the implement, a lower tool for performing a ground maintenance operation, and an intermediate connecting section for connecting the upper hand grip and the lower tool, which comprises:

an elongated rectangular carton defined by a front panel, a rear panel, two side panels, a top panel and a bottom panel, the implement being stored vertically in the carton with the lower tool being adjacent the bottom panel of the carton and the upper hand grip being adjacent the top panel of the carton, and one of the front or two side panels having an implement retaining panel articulable about a hinge line;

at least one display opening provided in an upper portion of the carton which is large enough to allow a user's hand to reach into the carton and grab and manipulate the implement while the implement is within the carton; and an enclosed storage compartment provided in a lower portion of the carton beneath the at least one display opening, the storage compartment being formed by the bottom panel, by lower portions of the front panel, rear panel and side panels, and by the implement retaining panel to enclose at least the lower tool of the implement, wherein the display opening is formed by a first flap cut in one panel of the carton which first flap is bent into a folded orientation adjacent the top panel of the carton, wherein the first flap is configured to receive and grip a portion of the upper hand grip of the implement when the first flap is in its folded orientation, wherein the retaining panel is formed by a second flap cut out of one of the panels of the carton and inwardly articulated about a hinge line, and wherein the second flap forming the retaining panel is cut out of one of the side panels of the carton.

4. A point of sale display apparatus according to claim 3, wherein the second flap forming the retaining panel is sufficiently large that such second flap, when articulated into the carton to engage the portion of the connecting section of the implement, provides a second display opening in one of the side panels of the carton which second display opening is sufficiently large to allow a user's hand to reach into the carton and grab and manipulate the implement while the implement is within the carton.

* * * * *